US010828545B2

(12) United States Patent
Engel

(10) Patent No.: US 10,828,545 B2
(45) Date of Patent: Nov. 10, 2020

(54) FOOTWEAR-BASED CLEANING SYSTEMS AND METHODS

(71) Applicant: Robert P. Engel, Laguna Hills, CA (US)

(72) Inventor: Robert P. Engel, Laguna Hills, CA (US)

( * ) Notice: Subject to any disclaimer, the term of this patent is extended or adjusted under 35 U.S.C. 154(b) by 0 days.

(21) Appl. No.: 16/785,531

(22) Filed: Feb. 7, 2020

(65) Prior Publication Data

US 2020/0171365 A1 Jun. 4, 2020

Related U.S. Application Data

(62) Division of application No. 15/445,865, filed on Feb. 28, 2017, now Pat. No. 10,576,341.

(51) Int. Cl.

| | |
|---|---|
| ***A63B 57/60*** | (2015.01) |
| ***A46B 9/02*** | (2006.01) |
| ***A46B 15/00*** | (2006.01) |
| ***A43B 5/18*** | (2006.01) |
| ***A43B 5/00*** | (2006.01) |

(52) U.S. Cl.

CPC ..... *A63B 57/60* (2015.10); *A43B 5/001* (2013.01); *A43B 5/18* (2013.01); *A46B 9/02* (2013.01); *A46B 15/0055* (2013.01); *A46B 2200/3073* (2013.01)

(58) Field of Classification Search

None

See application file for complete search history.

(56) References Cited

U.S. PATENT DOCUMENTS

| | | | | |
|---|---|---|---|---|
| D385,102 | S | 10/1997 | Avar | |
| 5,809,669 | A | 9/1998 | Hage et al. | |
| 5,930,920 | A * | 8/1999 | Arnold | A63B 57/60 15/210.1 |
| 5,979,008 | A | 11/1999 | Gordon | |
| 6,003,190 | A * | 12/1999 | Knudsen | A63B 57/60 15/160 |
| 6,393,648 | B1 | 5/2002 | Reynolds | |
| 8,413,352 | B2 | 4/2013 | Watkins | |
| 2003/0192141 | A1 * | 10/2003 | Rademacher | A47L 17/08 15/118 |
| 2006/0265828 | A1 * | 11/2006 | Mallatt | A46B 5/04 15/227 |
| 2009/0119857 | A1 | 5/2009 | Yurman et al. | |

(Continued)

FOREIGN PATENT DOCUMENTS

| | | | |
|---|---|---|---|
| GB | 2298353 | A | 9/1996 |
| WO | 1996009779 | A1 | 4/1996 |
| WO | 2006112826 | A1 | 10/2006 |

*Primary Examiner* — Eric W Golightly

(74) *Attorney, Agent, or Firm* — Donald E. Stout; Stout, Uxa & Buyan, LLP

(57) ABSTRACT

A system for securing cleaning surfaces onto the shoe of a golfer provides a simple, easy, and quick solution for cleaning the sand, dirt, or grass from the face of a golf club without delaying the next shot, breaking the golfer's concentration, slowing play, or any other inconveniences resulting from existing cleaning methods. The system includes two different cleaning tools, such as a brush and a buff pad, which are each secured adjacent to one another to the shoe for easy access by the club face between shots, without delay and with great cleaning effectiveness.

11 Claims, 4 Drawing Sheets

(56) References Cited

U.S. PATENT DOCUMENTS

| | | | | |
|---|---|---|---|---|
| 2009/0293215 | A1* | 12/2009 | Zhou | A43B 5/001<br>15/210.1 |
| 2011/0078926 | A1* | 4/2011 | Watkins | A63B 57/60<br>36/127 |
| 2012/0167318 | A1 | 7/2012 | Jaworski | |
| 2012/0272467 | A1 | 11/2012 | Forbes | |
| 2013/0333137 | A1 | 12/2013 | Dellecave et al. | |
| 2017/0072271 | A1* | 3/2017 | Betz | A63B 47/04 |

* cited by examiner

FIG. 8
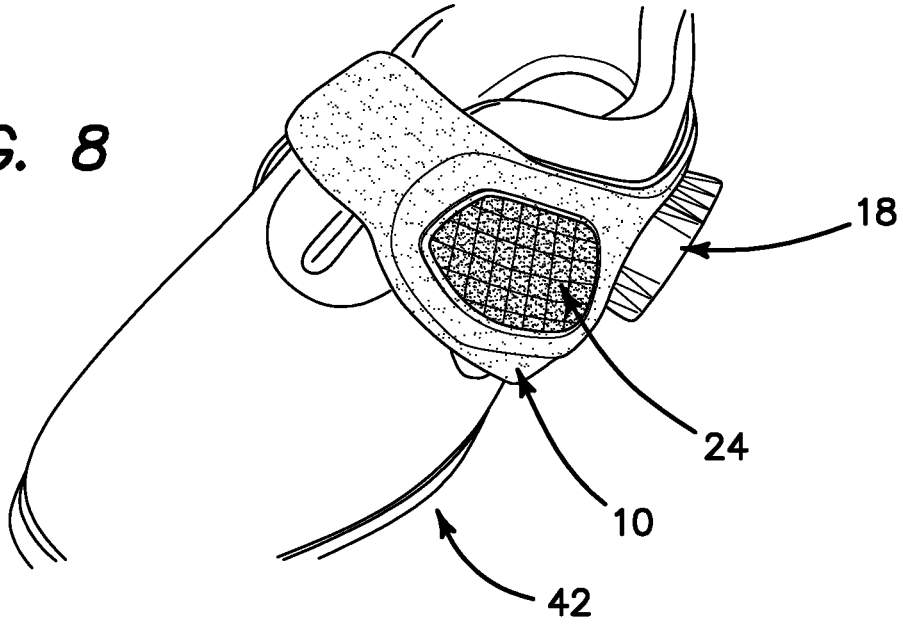
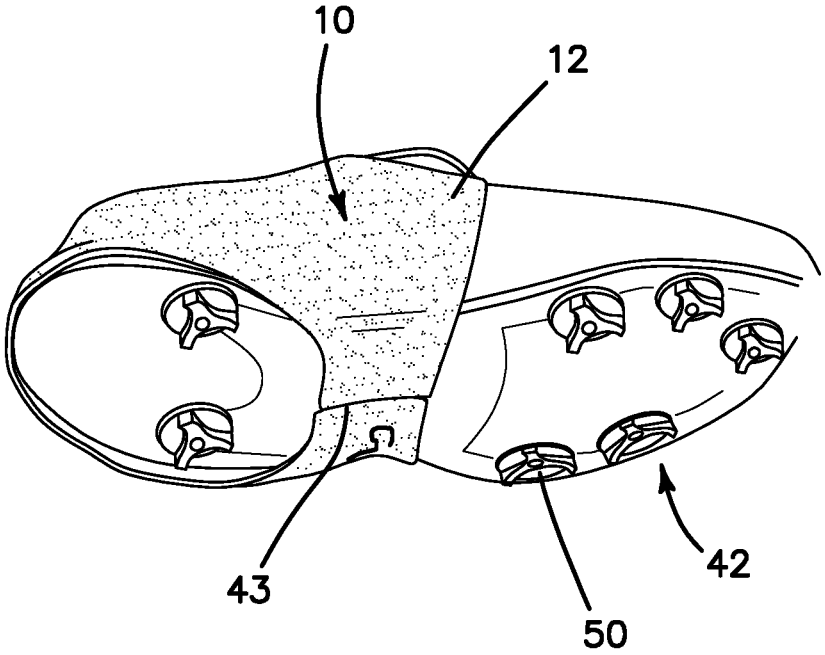
FIG. 9

FOOTWEAR-BASED CLEANING SYSTEMS AND METHODS

This application is a divisional application under 35 U.S.C. 120 of U.S. application Ser. No. 15/445,865, entitled Footwear-Based Cleaning Systems and Methods and filed on Feb. 28, 2017, issued as U.S. Pat. No. 10,576,341 on Mar. 3, 2020, which application is herein expressly incorporated by reference in its entirety.

BACKGROUND OF THE INVENTION

The present invention relates generally to systems and methods for cleaning golf club heads and other similar items. More specifically, the present invention relates to footwear-based cleaning systems and methods for golf club heads and the like.

When a golfer is practicing his swing, hitting golf balls on the driving range, he is hitting successive balls in a row from the grass. In such an instance, it becomes a problem for the golfer where he needs to clean the head of his club, particularly the irons, so he can hit the next shot with a reasonably clean golf club. Existing approaches to solving this problem are to 1) rub the dirt off with the toe of the golf shoe, 2) rub the golf club off on the grass next to the hitting area, 3) rub the golf club head off on your pants, 4) wipe the club with your hands, or 5) use a towel to clean the club. There is no easy, simple, functional solution to keep your irons clean while you are hitting golf clubs from the grass on the driving range.

The problem is that most golfers are too careless or hurried to stop between shots while practicing to clean their club head, particularly because they do not have a convenient solution for cleaning it. Consequently, the golfer will just continue to hit balls with dirt, sand, or grass on the face of the club head, thus creating additional unnecessary wear on the club and creating an uneven surface when trying to hit precise shots. Golf is a game of exact calculations. It's a math problem, really. Accordingly, what is needed is a system and methods for consistently and quickly cleaning the club head face in order to keep the variables facing a golfer when planning a shot to a minimum, thereby allowing a greater consistency of results, as well as extending the life and efficacy of the golf club.

SUMMARY OF THE INVENTION

The present invention comprises a system for securing cleaning surfaces onto the shoe of a golfer, thereby giving the golfer a simple, easy, and quick solution for cleaning the sand, dirt, or grass from the face of a golf club without delaying the next shot, breaking the golfer's concentration, slowing play, or any other inconveniences resulting from existing cleaning methods. The inventive system provides the advantages of a) allowing quick and easy cleaning of the face of the golf club between shots, b) increasing the efficiency of practice sessions, by avoiding the need to return to the golf bag, or use a towel or brush to clean the club face, c) a cleaning device positioned precisely where it is convenient to use between practice shots, or when you are preparing for a shot on the course, d) decreases the significant wear on the clubs, particularly irons, caused by hitting balls with dirty, or, worse, sandy club faces, e) achieving better and more consistent club feedback because there is no dirt or sand between the club face and the ball, and f) is easily installed and removed, as well as stored in a golf bag when not in use.

More particularly, there is provided a cleaning system for use on footwear, which comprises a support member comprised of a length of material, a first cleaning tool extending outwardly from the support member, and a second cleaning tool having a different construction than the first cleaning tool and also extending outwardly from the support member, adjacent to the first cleaning tool. By the term "different construction", it is meant that the two cleaning tools have differently designed elements and are purposed for different types of cleaning functions, as is described elsewhere in this application. For example, the two disclosed and illustrated cleaning tool embodiments are differently constructed in that one comprises a brush, having bristles, and the other comprises a buff pad, formed of an ultrasoft microfiber fabric covering a foam base. A third disclosed cleaning tool embodiment is a scratch pad, comprised of a coarse material for removing stubborn dirt or the like. The first and second cleaning tools are each fixedly secured to the support member.

As noted above, in the illustrated embodiments, the first cleaning tool comprises a brush formed of a plurality of bristles and is permanently secured in the support member. The second cleaning tool comprises a buff pad. The buff pad comprises a foam core covered by fabric, and the fabric cover comprises an ultrasoft microfiber. In one preferred embodiment, the fabric cover has an exposed surface comprising a plurality of ribs and adjacent channels to thereby form a plurality of touch points for effective cleaning effect. The buff pad comprises a unitary module including the foam core encapsulated in the fabric cover, and is permanently secured in the support member.

The support member comprises a first aperture through which the first cleaning tool extends and a second aperture through which the second cleaning tool extends, and is preferably fabricated of an elastomeric polymer, which comprises neoprene. The support member further comprises a continuous strap, where the continuous strap is formed by two attached ends of the support member. The support member comprises two ends and a releasable fastener for releasably securing the two ends together to secure the support member to a shoe.

A brush substrate is secured to a back side of the brush and a pad substrate secured to a back side of the buff pad. The cleaning system further comprises a backing piece secured to a back side of the support member and covering both of the brush substrate and the pad substrate.

In another aspect of the invention, there is provided a golf shoe having a cleaning system secured thereto. The golf shoe and cleaning system comprises an upper, a sole joining two ends of the upper, a first cleaning tool extending outwardly from the upper, and a second cleaning tool having a different construction than the first cleaning tool and also extending outwardly from the support member, adjacent to the first cleaning tool. The first and second cleaning tools are each fixedly secured to the upper.

A support member comprised of a length of material which is wrapped about the shoe, the support member comprising first and second apertures adjacent to one another, wherein the first cleaning tool extends through the first aperture and the second cleaning tool extends through the second aperture. The support member is further comprised of an elastomeric polymer and further comprises a continuous strap which extends across a width of the sole and two ends which extend across the upper and are joined together with a releasable fastener. The first cleaning tool comprises a brush and the second cleaning tool comprises a buff pad.

In still another aspect of the invention, there is described a method of cleaning a face of a golf club using a cleaning system attachable to a golf shoe having an upper and a sole joining two sides of the upper together, which comprises a step of providing a cleaning system comprising a support member comprised of a length of elastomeric material, a first cleaning tool extending outwardly through a first aperture in the support member, a second cleaning tool differently constructed than the first cleaning tool extending outwardly through a second aperture in the support member, a continuous strap, and two ends joinable together using a releasable fastener. Further steps include positioning the support member on the golf shoe with the first and second cleaning tools extending from the upper of the shoe and the continuous strap extending across a width of the sole of the shoe, extending the two ends of the support member across the upper and joining the ends together using the releasable fastener, and wiping the club face across one or both of the cleaning tools.

In yet another aspect of the invention, there is provided a golf shoe having a cleaning system secured thereto, which comprises an upper having a top portion accommodating shoe fasteners, a first side portion, and a second side portion, a sole joining the first and second side portions of the upper, a first cleaning tool extending outwardly from the first side portion of the upper, and a second cleaning tool having a different construction than the first cleaning tool and also extending outwardly from the first side portion of the upper, adjacent to, but spaced from, the first cleaning tool. The first and second cleaning tools are each fixedly secured to the upper and extend outwardly from the upper at all times. The cleaning surface of the first cleaning tool comprises a brush formed of a plurality of bristles and the cleaning surface of the second cleaning tool comprises a buff pad, the buff pad comprising a foam core covered by fabric.

A support member is comprised of a length of material which is wrapped about the shoe, the first and second cleaning tools being disposed on the support member. In some embodiments, the support member comprises first and second apertures adjacent to one another, the first cleaning tool extending through the first aperture and the second cleaning tool extending through the second aperture. The support member is comprised of an elastomeric polymer and further comprises a continuous strap which extends across a width of the sole and first and second ends which extend across the upper and are joined together with a releasable fastener.

The fabric may comprise an ultrasoft microfiber, having a plurality of ribs and adjacent channels to thereby form a plurality of touch points for effective cleaning effect. The buff pad comprises a unitary module including the foam core encapsulated in the fabric, and is permanently secured in the support member The elastomeric polymer may comprise neoprene.

The system may further comprise a fastener for securing the first end and the second end of the support member, so that when the first and second ends are secured, using the fastener, the support member forms said continuous strap, the fastener is spaced from each of the first and second cleaning tools by exposed portions of the support member. The fastener comprises a releasable fastener for releasably securing the first and second ends of the support member together to secure the support member to the shoe, wherein when the support member is secured to a shoe, the first and second cleaning tools are both adapted to be disposed adjacent to one another on the upper of the shoe, on a same side of a tongue on the shoe.

The invention, together with additional features and advantages thereof, may best be understood by reference to the following description taken in conjunction with the accompanying illustrative drawing.

BRIEF DESCRIPTION OF THE DRAWINGS

FIG. 8 is an isometric view similar to FIG. 5, for the perspective of a front end of the shoe; and FIG. 9 is an isometric view similar to FIG. 7, wherein the shoe is lying on its left side.

DETAILED DESCRIPTION OF THE INVENTION

Referring now more particularly to the drawings, there is shown in FIGS. 1-4 a footwear-based cleaning device 10 constructed in accordance with one embodiment of the present invention. The device 10 comprises a support member 12 which is preferably formed of an elastomeric polymer such as neoprene or another suitable durable but elastomeric material, and which is shaped to be wrapped about and secured to the rear half of a golf shoe or other suitable footwear. A first aperture 14 and a second aperture 16 are formed in the support member 12, as shown particularly in FIG. 3.

Figure 1:
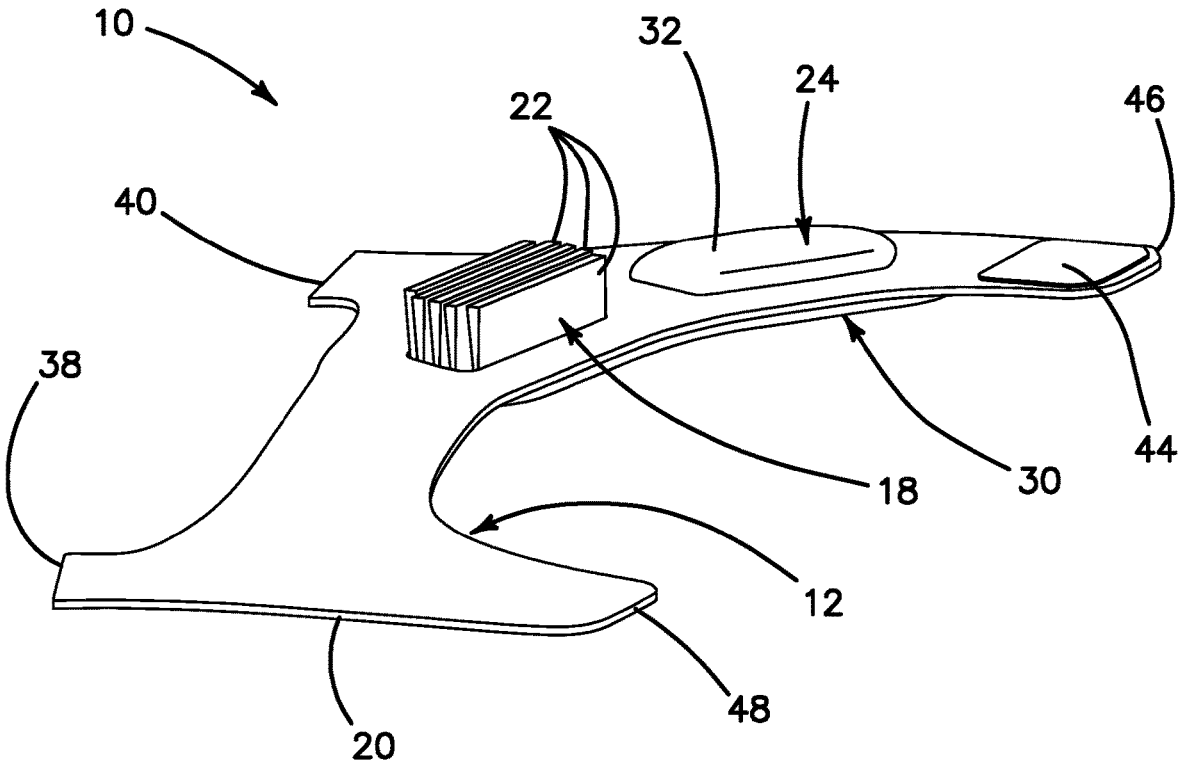
FIG. 1 is an isometric view of a cleaning device constructed in accordance with the principles of the present invention for attachment to footwear.
Figure 2:
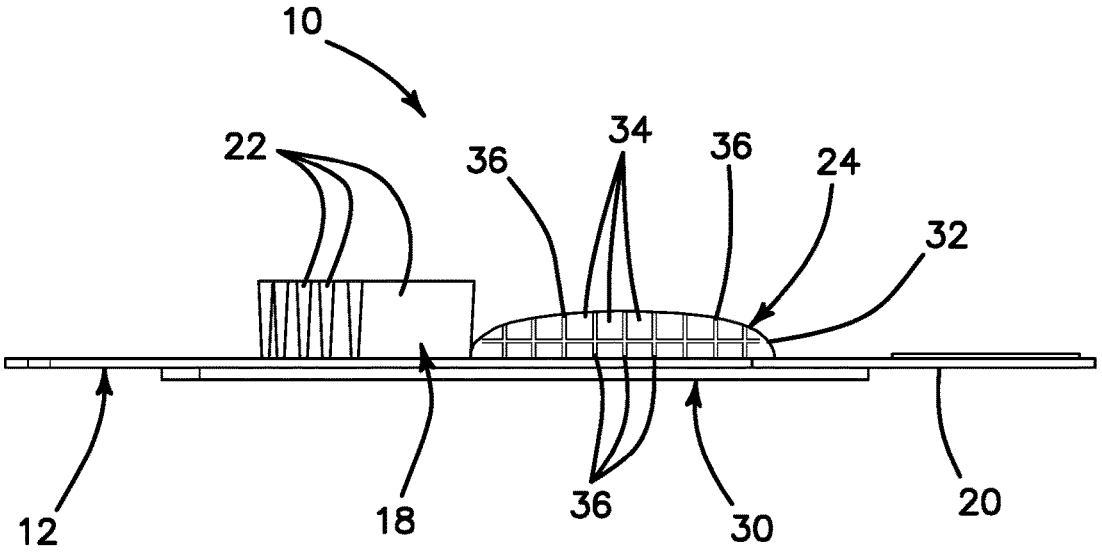
FIG. 2 is a plan view of the cleaning device shown in FIG. 1.
Figure 4:
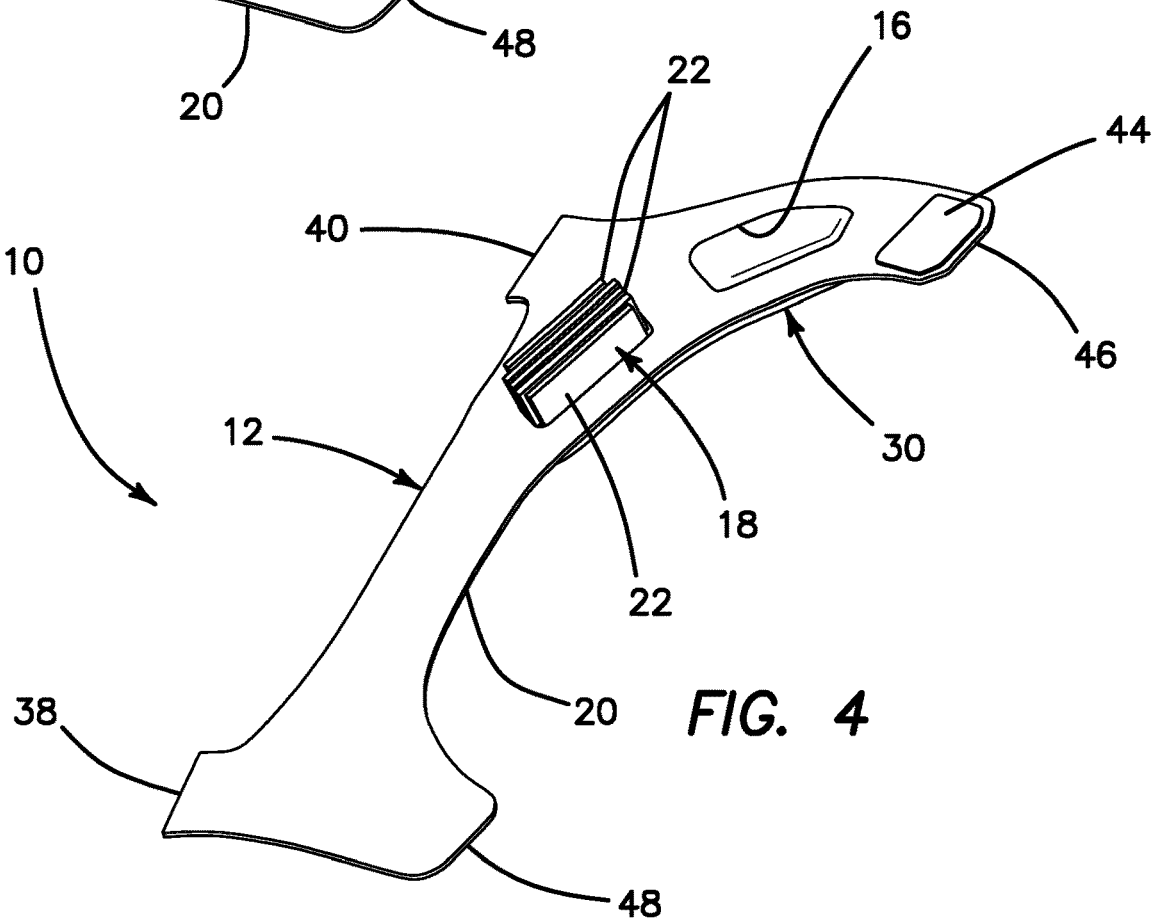
FIG. 4 is an isometric view similar to FIG. 1, from a somewhat different orientation.

Also provided are a plurality of cleaning tools for insertion through the first and second apertures 14 and 16, respectively. In the illustrated embodiment, the first cleaning tool comprises a brush 18 and is adapted for insertion upwardly through the aperture 14 from a bottom side 20 of the support member 12. Thus, as shown in FIGS. 1, 2, and 4, once assembled, the brush 18, formed of a plurality of rows of bristles 22, extends upwardly through the aperture 14 and is therefore conveniently accessible for use as a cleaning tool. Each cleaning tool 18, 24 may be used independently of each other, thus providing the essence of the unique optionality of the device 10.

Also illustrated in the disclosed representative embodiment is a second cleaning tool, comprising a buff pad 24. As is the case with the brush 18, the buff pad 24 is assembled to the device by moving it upwardly through the second aperture 16 in the support member 12. Once assembled, the buff pad 24 is also conveniently available for use as a cleaning tool.

Figure 3:
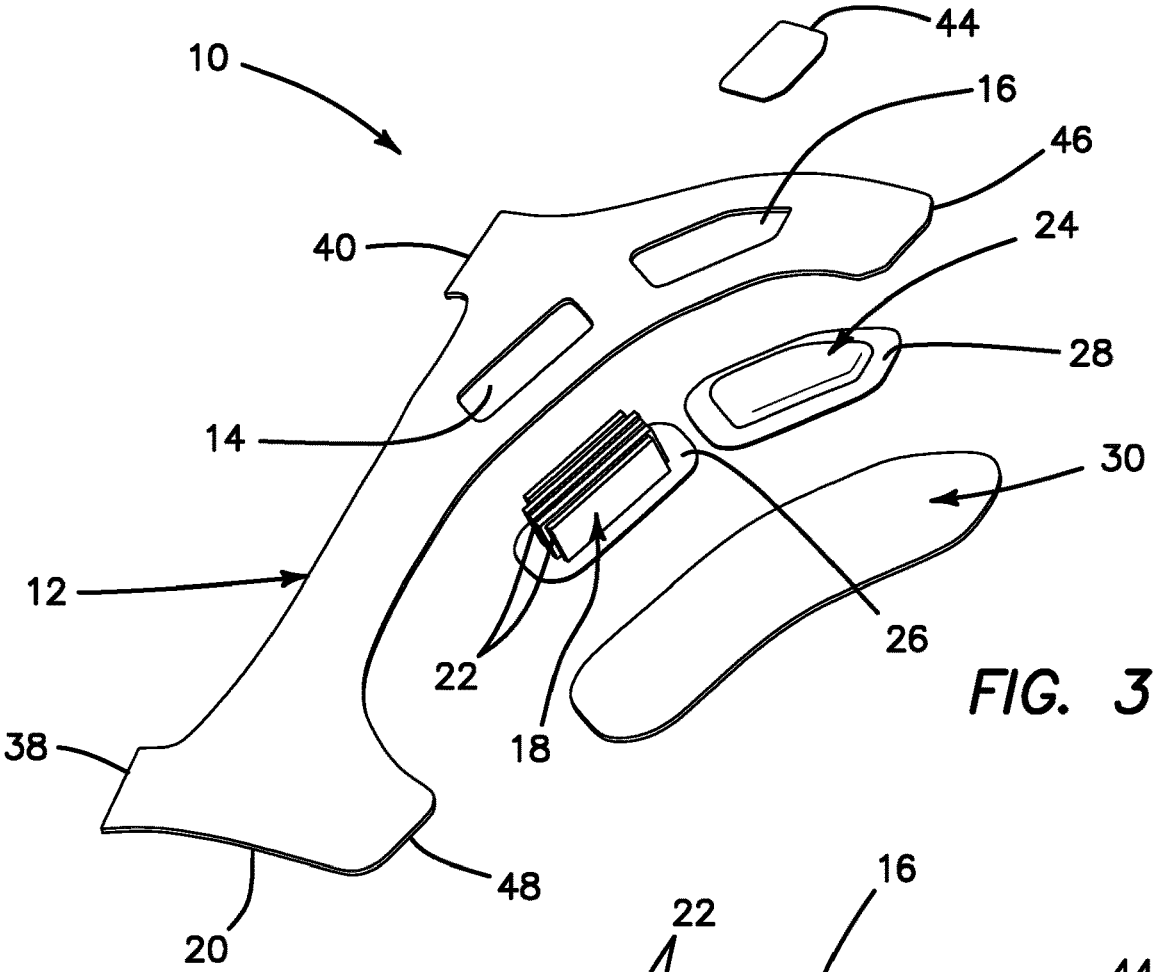
FIG. 3 is an isometric view of the cleaning device shown in FIGS. 1 and 2, in a disassembled state.

Details of the construction and assembly of the cleaning tools 18 and 24 are illustrated particularly in FIGS. 2 and 3. The cleaning tool or brush 18 is fixedly disposed on a substrate 26, while the cleaning tool or pad 24 is fixedly disposed on a substrate 28 (FIG. 3). This fixation may be accomplished by sewing, electronically welding, and/or bonding the cleaning tool 18, 24 to its respective substrate 26, 28. Other suitable attachment techniques may be used as well. Once the cleaning tool 18, 24 is inserted into its respective aperture 14, 16, as described above, it is fixed to the bottom side 20 of the support member 12, again using suitable methods such as sewing, bonding or electronic welding. The substrates 26, 28 are preferably formed of the same material as the support member 12, or a similar one, with elastomeric properties.

In the examples noted above, the first cleaning tool 18 comprises a brush formed of a plurality of rows of bristles 22. In golfing applications, this brush 18 will be particularly useful for contacting a club face and cleaning mud from the club face as the golfer moves the club face over the brush. The second cleaning tool 24 comprises a buff pad, which is particularly useful for removing grass from the club face. The positions of these two cleaning tools may be reversed, and a third different type of cleaning tool could be substituted for one or the other of the two discussed cleaning tools, such as a scratch pad or other suitable tool.

After the foregoing assembly steps have been completed, a backing piece 30 is fixedly attached to the bottom side 20 of the support member 12 using techniques similar to those discussed above, such as sewing or electronically welding the edges of the backing piece 30 to the support member 12, so that the backing piece 30 entirely covers the region of the bottom side 20 of the support member which includes the apertures 14 and 16 and their associated cleaning tools 18 and 24. The backing piece 30 also may comprise a polymer, such as neoprene or other suitable elastomeric material, similar to or the same as the material used to fabricate the support member 12.

The buff pad 24, in particular, may be particularly constructed for maximum cleaning advantage. In one particular embodiment, the pad 24 is constructed unitarily in the form of a "puck" and then assembled into the device 10. The "puck" 24 may comprise a fabric cover 32, wherein the fabric comprises an ultrasoft microfiber, enclosing and encapsulating a foam backing. The fabric 32 is electronically welded to seal the foam within the fabric, thereby forming the puck. Preferably, the fabric cover 32 comprises a series of ribs 34, separated by a series of channels 36, to create a series of touch points on the surface of the buff pad 24 for optimal cleaning effect. The buff pad 24, in its encapsulated puck form, is then secured into the device 10 as described above.

Figure 7:
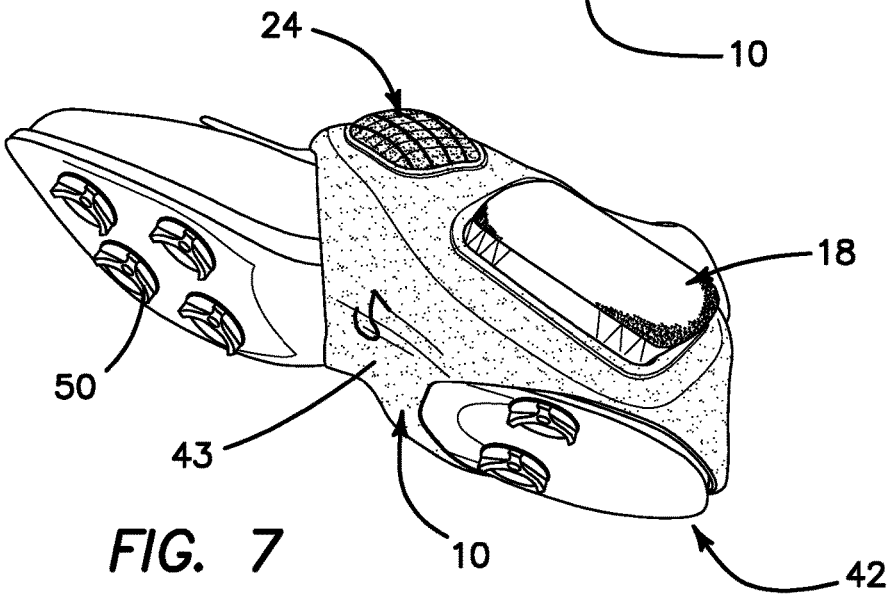
FIG. 7 is an isometric view similar to FIG. 5 wherein the shoe is lying on its right side.

Now, with reference to FIGS. 1, 3, and 4, to assemble the device 10 for installation on a golf shoe, first end 38 and second end 40 of the support member 12 are sewn together or otherwise secured to create a continuous strap 43 of the support member 12 which is adapted to extend along a width of the sole of a golf shoe 42) when the device 10 is installed on the shoe 42, as shown particularly in FIGS. 7 and 9. A releasable fastener 44 is disposed on a third end 46 of the support member 12. The releasable fastener 44 is preferably a hook and loop fastener of the type sold under the trademark VELCRO, but may be of other suitable types such as snaps, if desired. The third end 46 with its releasable fastener 44 is adapted to be attached to a fourth end 48 in order to secure the device 10 to the shoe 42.

Figure 5:
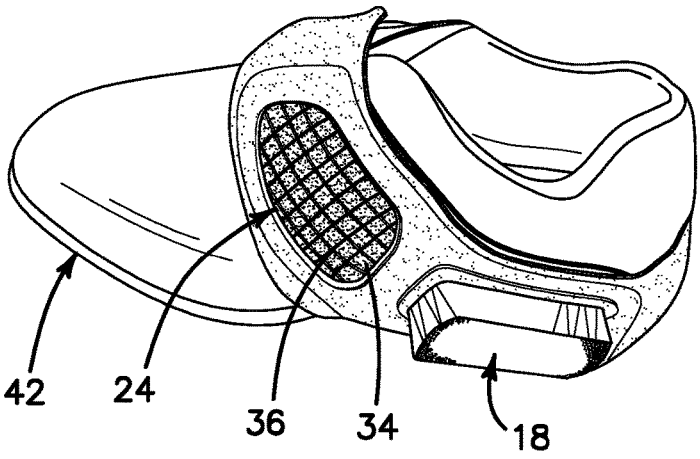
FIG. 5 is an isometric view of a device like that shown in FIGS. 1-4, secured to a golf shoe.
Figure 6:
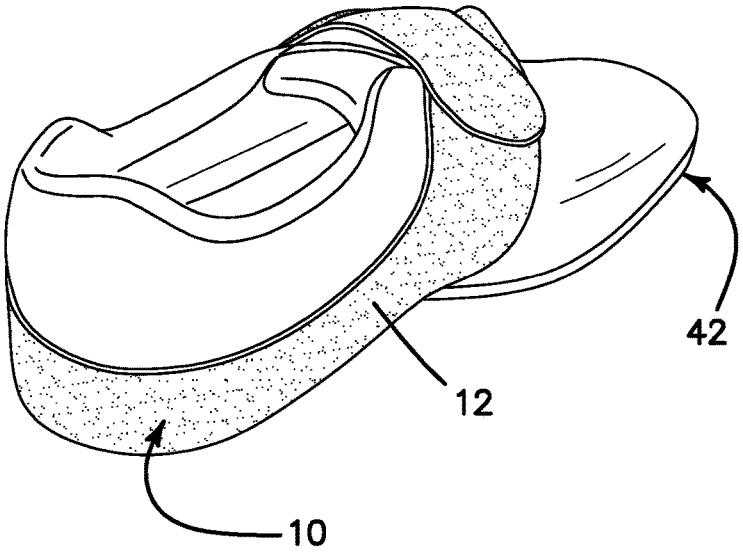
FIG. 6 is an isometric view similar to FIG. 5, showing the other side of the shoe and device.

With reference now particularly to FIGS. 5-9, an embodiment of the invention shown in FIGS. 1-4 wherein it has been secured to a golf shoe 42 is illustrated. To secure the device 10 to the shoe 42, the portion of the support member 12 supporting the cleaning tools 18 and 24 is arranged to lie along the left side of the shoe 42, as shown in FIG. 5, while remaining portions of the support member 12 extend around the heel and along the right side of the shoe 42 toward the front of the shoe, as shown in FIG. 6. When positioning the device 10 according to this arrangement, the continuous strap 43, formed by the attached support member first and second ends 38 and 40, respectively, extends across the width of the sole 50 of the shoe 43 (FIGS. 7 and 9). To complete the securement process, the third end 46 and fourth end 48 of the support member 12 are fastened to one another using the releasable fastener 44, across the laces of the shoe 42, as shown in FIGS. 5, 6, and 8.

Once the device 10 is in place on the shoe 42, it is ready for use. The golfer wearing the shoe 42 may, at any time, clean the face of a club head for a golf club he or she is using by passing the club head face across either or both of the brush 18 or buff pad 24, as discussed above, depending upon the nature of the debris or dirt that is on the club face.

Although a particular embodiment of the invention has been shown and described, one of ordinary skill in the art will recognize that certain variations are possible within the scope of the invention, some of which are described above and others of which are mentioned herein or self-evident to the skilled person. For example, although the embodiment shown is for a left shoe, it is clear that a similar embodiment may be made for a right shoe. Significantly, although the device 10 is releasably attachable to the shoe, for the purpose of giving the golfer the opportunity to use the shoe apart from the device 10, a shoe 42 could be fabricated which includes the cleaning tools 18 and 24 directly built into the upper of the shoe, on either side, so that they are a permanent part of the shoe. Importantly, regardless of whether the cleaning tools are permanently or temporarily attached to the upper of the shoe, they are securely in position, and extend in a substantially uniform fashion from the side of the shoe, meaning that the entire surface of the cleaning tool extends uniformly from the shoe upper and conforms to the surface of the upper upon which it is positioned, for convenient use. The device 10 may be designed, if desired, so that the cleaning tools 18 and 24 are modular and interchangeable with new or different tools. For example, rather than sewing, bonding, or electronically welding the cleaning tools to the support member 12 or directly to the upper of the shoe, the cleaning tools may be attached thereto using releasable fasteners, such as hook and loop fasteners. Permanent attachment has been found to afford better functionality, however, because of convenience and the fact that the tools will stay in place even during rough use.

Because the support member 12 and other elements are fabricated of a durable, elastomeric material, as disclosed above, its stretchiness permits a universal fit of the device 10 to multiple shoe sizes, and is sturdy, comfortable and light. Because it is readily removable from the shoe 42, the device is easily washed.

Accordingly, although exemplary embodiments of the invention have been shown and described, it is to be understood that all the terms used herein are descriptive rather than limiting, and that many changes, modifications, and substitutions may be made by one having ordinary skill in the art without departing from the spirit and scope of the invention.

What is claimed is:

1. A golf shoe having a cleaning system secured thereto, the shoe comprising:

an upper having a top portion accommodating shoe fasteners, a first side portion, a second side portion, and an opening in the top portion behind the shoe fasteners adapted for insertion of a wearer's foot into the shoe;

a sole joining the first and second side portions of the upper;

a first cleaning tool extending outwardly from the first side portion of the upper, the first cleaning tool having a length and a width, wherein the length of the first cleaning tool is greater than the width of the first cleaning tool, the first cleaning tool being oriented so that its length lies along a length of the shoe, beneath the opening, and its width lies along a height of the shoe;

a second cleaning tool having a length and a width and also extending outwardly from the first side portion of the upper, adjacent to, but spaced from, the first cleaning tool, the length of the second cleaning tool being oriented in a different direction than the length of the first cleaning tool;

the first and second cleaning tools each being fixedly secured to the upper and extending outwardly from the upper at all times;

wherein a cleaning surface of the first cleaning tool comprises a brush formed of a plurality of bristles and a cleaning surface of the second cleaning tool comprises a buff pad, the buff pad comprising a foam core covered by fabric.

2. The golf shoe as recited in claim 1, and further comprising a support member comprised of a length of material which is wrapped about the shoe, the first and second cleaning tools being disposed on the support member.

3. The golf shoe as recited in claim 2, wherein the support member comprises first and second apertures adjacent to one another, the first cleaning tool extending through the first aperture and the second cleaning tool extending through the second aperture.

4. The golf shoe as recited in claim 2, wherein the support member is comprised of an elastomeric polymer and further comprises a continuous strap which extends across a width of the sole and first and second ends which extend across the upper and are joined together with a releasable fastener.

5. The golf shoe as recited in claim 1, wherein the fabric comprises an ultrasoft microfiber.

6. The golf shoe as recited in claim 5, wherein the fabric comprises a plurality of ribs and adjacent channels to thereby form a plurality of touch points for effective cleaning effect.

7. The golf shoe as recited in claim 6, wherein the buff pad comprises a unitary module including the foam core encapsulated in the fabric, and is permanently secured in the support member.

8. The golf shoe as recited in claim 4, wherein the elastomeric polymer comprises neoprene.

9. The golf shoe as recited in claim 4, and further comprising a fastener for securing the first end and the second end of the support member, so that when the first and second ends are secured, using the fastener, the support member forms said continuous strap, the fastener being spaced from each of the first and second cleaning tools by exposed portions of the support member.

10. The golf shoe as recited in claim 9, wherein the fastener for securing the first and second ends comprises a releasable fastener for releasably securing the first and second ends of the support member together to secure the support member to the shoe, wherein when the support member is secured to a shoe, the first and second cleaning tools are both adapted to be disposed adjacent to one another on the upper of the shoe, on a same side of a tongue on the shoe.

11. A method of cleaning a face of a golf club using a cleaning system attachable to a golf shoe having an upper and a sole joining two sides of the upper together, the method comprising steps of:

providing a cleaning system comprising a support member comprised of a length of elastomeric material, a first cleaning tool extending outwardly through a first aperture extending entirely through the support member, a second cleaning tool differently constructed than the first cleaning tool, the second cleaning tool extending outwardly through a second aperture extending entirely through the support member, a continuous strap, and two ends joinable together using a releasable fastener;

positioning the support member on the golf shoe with the first and second cleaning tools extending from the upper of the shoe and the continuous strap extending across a width of the sole of the shoe;

extending the two ends of the support member across the upper and joining the ends together using the releasable fastener; and wiping the club face across one or both of the cleaning tools.

* * * * *